United States Patent [19]

Bierbaum et al.

[11] Patent Number: 4,682,555

[45] Date of Patent: Jul. 28, 1987

[54] PROCESS FOR THE MANUFACTURE OF FITTED ELASTIC BEDSHEETS OR SIMILAR SEAT COVERS

[75] Inventors: Joe Bierbaum, Borken; Siegfried Henze, Hohenroth; Karl Müssig, Bad Königshofen; Hans Ziegler, Grossbardorf, all of Fed. Rep. of Germany

[73] Assignee: Texpa Arbter Machinenbau GmbH, Saal, Fed. Rep. of Germany

[21] Appl. No.: 935,840

[22] Filed: Nov. 28, 1986

[30] Foreign Application Priority Data

Nov. 30, 1985 [DE] Fed. Rep. of Germany ..... 3542445

[51] Int. Cl.[4] ..... D05B 1/00; D05B 97/00

[52] U.S. Cl. ..... 112/262.1; 112/121.26; 112/104; 112/305; 112/262.3

[58] Field of Search ..... 112/262.1, 262.3, 265.1, 112/121.11, 121.15, 121.26, 104, 305

[56] References Cited

U.S. PATENT DOCUMENTS 3,208,419 9/1965 Frydryk ..... 112/262.2

4,594,956 6/1986 Vartoukian et al. ..... 112/262.1

*Primary Examiner*—H. Hampton Hunter

*Attorney, Agent, or Firm*—Quaintance, Murphy & Presta

[57] ABSTRACT

In order to be able to execute the commercial production of fitted elastic bedsheets from a strip of cloth, markings are applied to the strip of cloth, which determine the attachment points for stretched elastic bands, the transverse cutting lines on the strip of cloth and the seams at the corners of each piece of cloth to be cut from the strip of cloth. The stretched elastic bands are sewn on or in the edges of the strip of cloth, while the strip of cloth is being moved in the lengthwise direction and is held in a flat state. Then individual pieces of cloth are cut from the strip of cloth. The stretched elastic bands then are sewn on or in the two edges of the pieces of cloth being moved transverse to the length of the strip of cloth, which corresponds to the cut edges. With this sewing process, the pieces of cloth are likewise held in a flat state. At this point, the piece of cloth is folded diagonally at each corner, so that the folded cloth segments lie one over the other and the corners adjacent to the edges of cloth pieces are flush. Then the folded cloth segments are sewn together at each corner of the piece of cloth along the markings for the seam and finally the folded cloth piece segments are cut off along each seam with cloth corners to the side. In the process, the stretched elastic bands can advantageously be automatically mechanically connected with the strip of cloth or the pieces of cloth which are already cut off. Thereafter the still required manual work steps are less time-consuming and can be executed simply at a manual sewing site.

6 Claims, 7 Drawing Figures

PROCESS FOR THE MANUFACTURE OF FITTED ELASTIC BEDSHEETS OR SIMILAR SEAT COVERS

BACKGROUND OF THE INVENTION

The present invention relates to a process for the manufacture of fitted elastic bedsheets or similar seat covers, in which retangular pieces of cloth are cut from a strip of cloth, and the corners are cut off by almost retangular punches, and then in turn two adjacent cut edges are connected by a seam, and in which, thereafter, stretched elastic bands or the like are sewn on or in the suitably folded over edges of the pieces of cloth, in stretched-out state, which in slackened state then draw the cloth together to form folds or wrinkles.

Until this time, fitted elastic bedsheets have been manufactured of textiles or textile-like materials (called nonwoven materials), in a work process which is for the most part manual. In this manual process, the strip of cloth is first of all spread out in stacks with a lengthwise laying mechanism, the stack is then cut through the middle and finally the corners of the cut edges of the two stacks of halves which are formed are cut off by rectangular or almost retangular punches. All other work processes for the manufacture of fitted elastic bedsheets must then be carried out manually. The cut pieces are transported individually to a manual sewing station, at which the two cut edges which are then adjacent to each other are laid flush to each other one after the other in the areas of the cut-out corners of the pieces and sewn together. When the four required seams have been applied in this manner to each piece of cloth, then -from the point of view of dimensions- a box-like configuration of the cloth is already attained.

Thereafter, stretched elastic bands or similar pulling elements are applied to this partially prefabricated fitted elastic bedsheet. This happens at another manual sewing station, to which the partially fabricated fitted elastic bedsheets must be conveyed. At this manual sewing station, the elastic bands in stretched-out state are generally sewn in or onto the edges of the pieces of cloth along both narrow sides of the partially fabricated fitted elastic bedsheets, so that they run a bit further over the relevant corners in the lengthwise side of the relevant fitted elastic bedsheets and in slackened state draw together and wrinkle the material in the area of the corner.

One particular drawback with this method of production is the great manual work required, for which it is to be noted that the aforementioned work processes do not include automatic mechanical finishing of the fitted elastic bedsheets. Also, undesirable conveyance paths are required for the sewn material between the cutting station and the manual sewing station, which also requires relatively great use of space for the intermediate storage.

SUMMARY OF THE INVENTION

The object of the present invention is to disclose a commercially effective and for the most part mechanical method for the manufacture of fitted elastic bedsheets or similar seat covers. With this process, the conveyance paths and storage site for the sewn article can be minimized.

The above object is attained by the process which is characterized according to the invention by:

(a) application of markings in the cloth for determination of the mounting sites of the stretched elastic bands, the transverse cutting lines of the strip of cloth and the seam at each corner which is to be separated from a piece of cloth;

(b) sewing the stretched elastic bands on or in the edges of the strip of cloth, which is being held in a flat state;

(c) cutting the individual pieces of cloth from the strip of cloth;

(d) sewing the stretched elastic bands on or in the two edges of the pieces of cloth which correspond to the cut edges, while the pieces of cloth are held in a flat state;

(e) providing diagonal folds at each corner of a piece of cloth, so that the folded cloth sections run along smoothly one upon the other and the two edges of the adjacent pieces of cloth are flush at each corner;

(f) sewing together of the folded-together cloth segments at each corner of a piece of cloth along the markings for the seam; and (g) cutting off of the folded cloth piece segments with the cloth corners to the side along each seam.

The process according to the present invention has the advantage that the application of the markings on the strip of cloth as well as the completely mechanical sewing of the stretched elastic bands in stretched-out state on or in the edges of the strip of cloth or on the pieces of cloth which are separated from these, i.e. automatically, can be executed in a suitable device. Thus, the time-consuming manual sewing required in connection with the stretched elastic bands is omitted, which was formerly a problem in that these had to be sewn in stretched-out state.

The feed process according to the present invention is still to be carried out manually only after the diagonal folds are made at each corner of a piece of cloth, and these cloth sections which are folded together are sewn together and are separated by cutting, which is no problem for a skilled tailor or seamstress, since it has to do with relatively short seams and cutting lengths on flat cloth pieces. Further reducing the process according to the invention in comparison to the state of the art are the conveyance paths for the sewn article and the site for intermediate storage of the article, since only one manual sewing station is required.

Other configurations are within the scope of the present invention. Control technology is thus important, when strips of cloth are moved in lengthwise direction, and strip lengths corresponding to the cut lengths for the individual fitted elastic bedsheets are measured off and the strip of cloth is maintained and the markings are applied to the strip of cloth dependent upon these measurements, for determination of the attachment areas of the stretched elastic bands, the transverse cutting lines and the seams.

A savings with the stretched elastic bands and with that a further increase of the commercial value of the process according to the invention is attained in that the stretched elastic bands are sewn on or in at some spacing from the corners of a piece of cloth. If the folded cloth piece segments are then separated off with the corners formed in them, none or practically none of the elastic band is lost.

The commercial importance of the process can be further increased according to another configuration of the invention wherein the stretched elastic bands for a piece of cloth are sewn with uniform spacing from each other in or on the edges of the pieces of cloth on both sides of the relevant seam.

Other configurations of the present process lead to a structural simplification of the device for execution and sewing on of the elastic bands.

BRIEF DESCRIPTION OF THE DRAWINGS

The invention is explained in more detail hereinafter relative to the drawings of one exemplary embodiment. They show.

DESCRIPTION OF THE PREFERRED EMBODIMENTS

Figure 2:
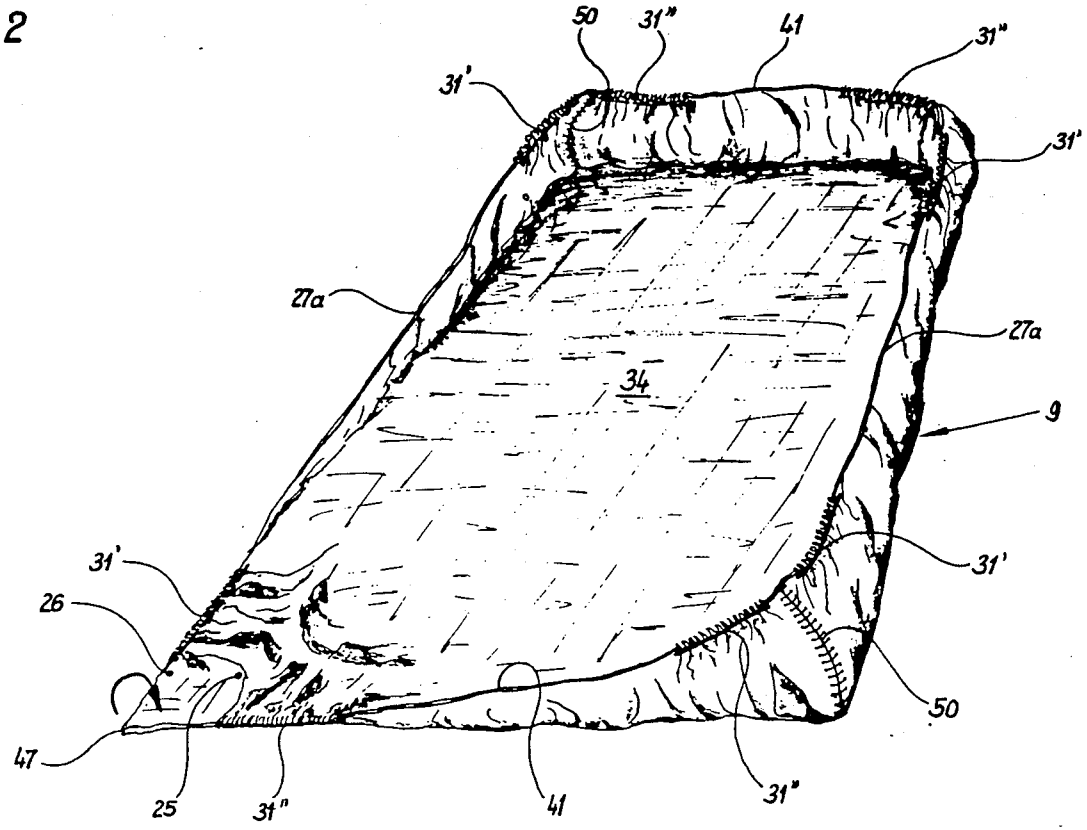
FIG. 2 is another perspective view of an almost completed fitted elastic bedsheet, which is brought into a shape of proper dimensions and in which only one more corner is to be worked.
Figure 7:
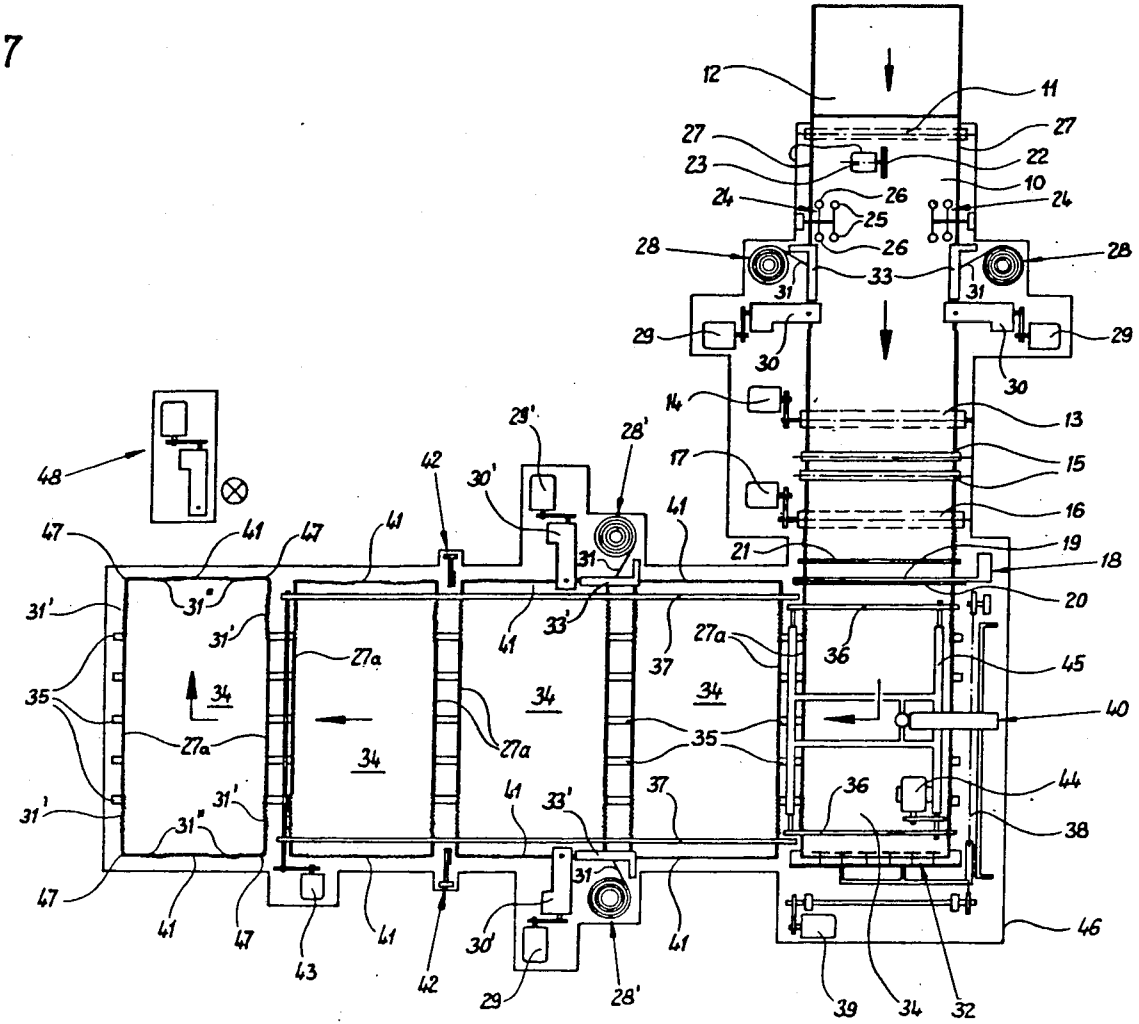
FIG. 7 is a diagrammatic plan view of an apparatus for the manufacture of fitted elastic bedsheets according to the process of the present invention.

As a starting material for the fitted elastic bedsheets, which is shown by the numeral 9 in FIG. 2, nearly completed, a strip of cloth 10 is used, which is being drawn from a supply 12 over a guide pulley 11 and also by a drive roller 13, powered intermittently by an electric motor 14, as shown in FIG. 7. Two compensating rollers 15 stretch the strip of cloth 10 in the lengthwise direction before it runs over another drive roller 16 in the direction of cutting station 18. Drive roller 16 is powered by an electric motor 17 synchronously with the drive roller 13, intermittently.

Cutting station 18 includes a powered cutting blade 19 which moves up and down, and a stationary counter-blade 20. A retaining strip 21 is series-connected before both blades 19, 20 where it is moved up and down by a suitable drive means (not shown), which cooperates with a mounting plate which is located beneath cloth strip 10, in order to clamp cloth strip 10 tightly, before cutting blade 19 starts its operation. Also after the cutting, strip of cloth 10 is still clamped tightly for a short period, for reasons which remain to be described. A mounting plate extends beneath strip of cloth 10 likewise between drive roller 13 and guide pulley 11. A measuring wheel 22, powered by the drawing of strip of cloth 10 from supply 12, is connected with a transmitter 23 to receive power, which then, through a control circuit including electric motors 14, 17, controls the mechanism so that in turn a length of the strip which corresponds to the cut length of a fitted elastic bedsheet is drawn from supply 12.

Figure 1:
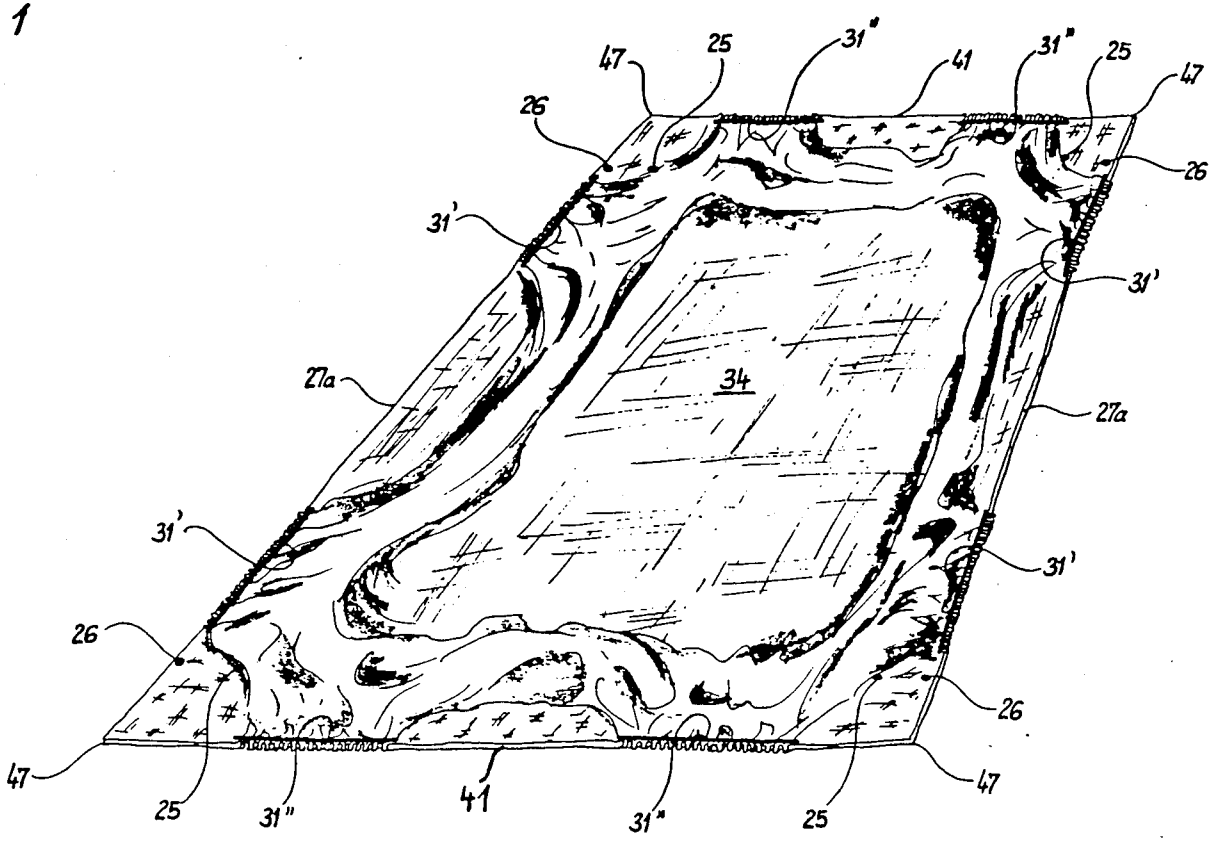
FIG. 1 is a perspective view of a partially fabricated fitted elastic bedsheets, to which are already applied all of the stretched elastic bands.

When drive rollers 13, 16 are then held still and strip of cloth 10 stands still, two marking devices 24 which lie next to each lengthwise edge 27 of the strip of cloth 10 are set in operation to supply four marking points 25, 26. Depending upon what sensing member is used in the device, these marking points could consist of contrasting colors, including fluorescent colors for an optical scanning, or other suitable markings. Marking points 26 are scanned by suitable sensors (not shown), which control a feed device for a stretched elastic band 21 through a control circuit and also control the drive motor 29 for a sewing machine 30 facing each lengthwise edge 27 of strip of cloth 10. When strip of cloth 10 is drawn in the direction of the arrow for a cut length of a fitted elastic bedsheet by drive rollers 13, 16 and a clamp 32 which is still to be described, marking points 26 connect feed device 28 for the stretched elastic band 31, which is guided by guide and stretch devices 33 which are shown only diagrammatically in stretched-out state parallel to lengthwise edges 27 of strip of cloth 10, so that when sewing machine 30 comes parallel to the edges of cloth strip 10, it is sewn on. When marking points 26 run through second sensors which are at some distance from the first sensors in the direction of movement of the strip of cloth, further feed of elastic strips 31 is interrupted, the sewn-on elastic strip segments are separated and the drive of sewing machine 30 is disconnected. Thus only stretched elastic bands of certain length, as shown in FIG. 1 at 31', are sewn onto strip of cloth 10, and actually at the segments of strip of cloth 10 marked off by marking points 26.

Through sensors (not shown), marking points 26 also control the drive of cutting blade 19 which can be moved up and down, so that the cut runs between two marking points 25, 26 at some distance from each other in lengthwise direction on cloth strip 20. When strip of cloth 10 is clamped tightly by retaining strip 21 and the separating cut is made by blade 19, the separated piece of cloth 34 can be carried away transverse to the length of strip of cloth 10 by bottom conveyor belt 35 and top conveyor belt 36 or 37 in the direction of the arrow of FIG. 7, to the left.

Clamp 32 is driven back and forth on a guide (not shown) by an endless drive member 38 over electric motor 39. A lift device 40 lifts the top conveyor belt 36 for such a distance that clamp 32 can be moved forward under conveyor belt 37 to engage cutting station 18 and can move back. The control of electric motor 39 for drive of clamp 32 and its gripping movement occurs through transmitter 23 over the already selected control circuit synchronous to electric motors 14, 17 of drive rollers 13, 16.

When a piece of cloth 34 which is separated off as in FIG. 7 is moved away to the left by conveyor belt 35, 36, clamp 32 is moved against cutting station 18, where it picks up the cut edge of strip of cloth 10 which is still clamped tightly by retaining strip 21. Following release of strip of cloth 10 by retaining strip 21, clamp 32 is moved back into its original position shown in FIG. 7, while at the same time drive rollers 13, 16 are activated in order to draw down another length of strip cloth 10 from supply 12. When this length has been reached, motors 14, 17 and 39 are again disconnected.

After the next subsequent separation of another piece of cloth 34 by cutting blade 19 and conveyance of this piece of cloth 34 in the direction of the arrow of FIG. 7, to the left, clamp 32 is moved against cutting station 18 again and the described procedure is repeated. The operation of retaining strip 21 and cutting blade 19 as well as the lift device 40 are controlled by the aforementioned electric control circuit, which is connected electrically with transmitter 23.

When the individual pieces of cloth 34 are moved to the left by bottom and top conveyor belts 35, 37, in the flat state, as in the direction of the arrow in FIG. 7, to the left, two more stretched elastic bands 31" (FIG. 1) of certain lengths are sewn on both of their cut or transverse edges 41. This work process corresponds to that already described with the sewing on of the elastic strips 31' and the basic feed devices 28' and sewing machines 30' for this purpose correspond in their arrangement and operation to those already described. Corresponding parts are therefore provided with identical reference numbers, which however are differentiated by an additional apostrophe. Two threads 42 are engaged by thread-cutting devices, which cut through the treads coming out of sewing machines 30'. Top conveyor belts 36 are powered by an electric motor 43, and are driven synchronously with bottom conveyor belt 35 by a suitable electric motor (not shown) and the drive of top conveyor belt 36 by an electric motor 44, supported on a frame 45, which can be raised and lowered by lifting device 40. Transmitter 23 likewise controls motors 43, 44 for conveyor belts 36, 37 and the motor for bottom conveyor belt 35, through the electric control circuit with a corresponding time delay, or by sensors which scan the lengthwise edges 27*a* of pieces of cloth 34, in the area of the movement of clamp 32.

The individual assemblies of the device described above are all mounted on a machine frame 46. It is important that the stretched elastic bands 31' and 31'' be arranged at some spacing from each other along lengthwise edges 27*a* and transverse edges 41 of a piece of cloth 34 at uniform spacing, and also at identical spacing from each corner 47 of a piece of cloth 34. Stretched elastic bands 31' and 31'' sewn on in the above manner in stretched-out state when in slackened state produce the wrinkles and fold formation shown in FIG. 1 on a piece of cloth 34. It is also important that the above described sewing of the stretched elastic bands on lengthwise edges 27 of strip of cloth 10 or on the transverse edges 41 of pieces of cloth 34 be in a state in which strip of cloth 10 or piece of cloth 34 are held in a flat state, and are moved in directions indicated in FIG. 7 by arrows.

If desired, border pipings could also be provided in the area of feed devices 28, 28' for stretched elastic bands 31, which wrap lengthwise edges 27 of strip of cloth 10 or transverse edges 41 of pieces of cloth 34, so that the stretched elastic bands are also provided with pipings, which wrap lengthwise edges 27 of strip of cloth 10 or transverse edges 41 of pieces of cloth 34, so that the stretched elastic bands can be sewn into these piped edges.

Figure 3:
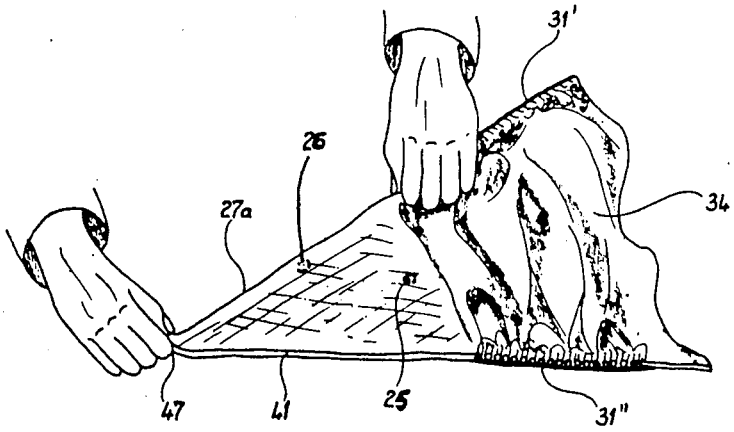
FIGS. 3 to 6 are perspective views of various work phases in the working of a corner of a partially fabricated fitted elastic bedsheet in accordance with the present invention.
Figure 4:
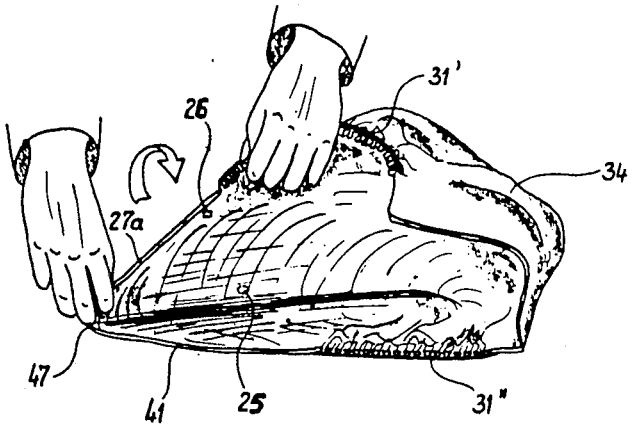
Figure 5:
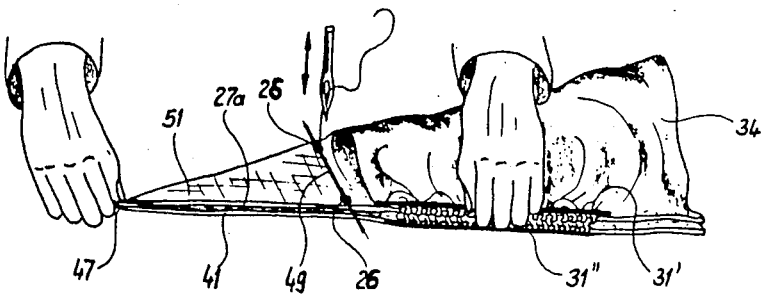
Figure 6:
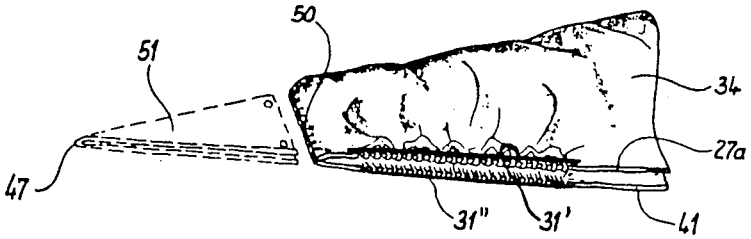

When a piece of cloth 34 has been brought by bottom conveyor belt 35 into the outermost left discharge position shown in FIG. 7, it is removed by a tailor or seamstress in the direction of the arrow and is further worked at a manual sewing station 48. At this sewing station 48, piece of cloth 34 is then folded diagonally at each corner 47, as shown in FIGS. 3 to 5, so that the corners 47 of adjacent cloth piece edges 27*a* and 41 are flush (FIG. 5). Then a seam 50 is formed along the imaginary line 49 connecting marking points 25 and 26, and the folded segment of cloth 51 is cut from piece of cloth 34 along seam 50 with corner 47 to the side. When these work steps are completed on all four corners 47 of a piece of cloth 34, the fitted elastic bedsheets are completed.

Control of feed devices 28, 28' for elastic strips 31 can differ from that shown in the exemplary embodiment in such a manner that, e.g., at lengthwise edges 27*a* and/or transverse edges 41 of pieces of cloth 34 a stretched elastic band is arranged in turn to pass therethrough, which however preferably has the spacing from the adjacent corners 47 described in connection with the exemplary embodiment.

What is claimed is:

1. Process for the manufacture of fitted elastic bedsheets or similar seat covers, in which rectangular pieces of cloth are cut in segments from a strip of cloth, of which the corners are separated by approximately rectangular punches, and then in turn two adjacent cut edges are connected by a seam, and in which, furthermore, stretched elastic bands or the like are sewn in stretched-out state in or on the corresponding piped edges of the pieces of cloth, which in slackened state cause a drawing together of the cloth with formation of folds or wrinkles, characterized by:

(a) application of markings on the strip of cloth for determination of the attachment areas for the stretched elastic bands, the transverse cutting lines on the strip of cloth and the seam at each corner to be cut from a piece of cloth;

(b) sewing of the stretched elastic bands on or in the edges of the strip of cloth, while this is being held in a flat state;

(c) cutting of the individual pieces of cloth from the strip of cloth;

(d) sewing of the stretched elastic bands on or in the two edges of the pieces of cloth which correspond to the edges of the cut while the pieces of cloth are held flat;

(e) diagonal folding at each corner of a piece of cloth, so that the folded cloth segments lie flat one atop the other and the two adjacent edges of the cloth are flush at each corner;

(f) sewing together of the folded segments of cloth at each corner of a piece of cloth along the markings for the seam; and (g) separation of the folded segments of cloth from the cloth corners to the side along each seam.

2. Process as in claim 1, characterized in that lengths of the strip of cloth are measured off while the strip is moving in the lengthwise direction for the individual fitted elastic bedsheets, the strip of cloth is held dependent upon this measurement, and the markings are applied to the strip of cloth for determination of the attachment segments for the stretched elastic bands, the transverse cutting lines and the seams.

3. Process as in claim 1, characterized in that the stretched elastic bands are sewn on or in at a distance from the corners of a piece of cloth.

4. Process as in claim 1, characterized in that the stretched elastic bands are sewn on or in at uniform spacing from each other at the edges of the piece of cloth.

5. Process as in claim 1, characterized in that the stretched elastic bands are sewn on or in the edges of the strip of cloth, while the strip of cloth is being moved in lengthwise direction.

6. Process as in claim 1, characterized in that the stretched elastic bands corresponding to the two edges of the piece of cloth which correspond to the cut edges are sewn on or in while the pieces of cloth are being moved transverse to the length of the strip of cloth.

* * * * *